US006756992B2

(12) United States Patent
Toji et al.

(10) Patent No.: US 6,756,992 B2
(45) Date of Patent: Jun. 29, 2004

(54) DISPLAY EQUIPMENT, DISPLAY METHOD, AND STORAGE MEDIUM STORING A DISPLAY CONTROL PROGRAM USING SUB-PIXELS

(75) Inventors: Bunpei Toji, Iizuka (JP); Tadanori Tezuka, Fukuoka-ken (JP); Hiroyuki Yoshida, Fukuoka-ken (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 309 days.

(21) Appl. No.: 09/907,550

(22) Filed: Jul. 17, 2001

(65) Prior Publication Data

US 2002/0008713 A1 Jan. 24, 2002

(30) Foreign Application Priority Data

Jul. 18, 2000 (JP) ..... 2000-217346
Jul. 19, 2000 (JP) ..... 2000-219517
Jul. 21, 2000 (JP) ..... 2000-220043

(51) Int. Cl.[7] ..... G09G 5/00

(52) U.S. Cl. ..... 345/613; 345/614; 345/660; 382/256; 382/257

(58) Field of Search ..... 345/613, 614, 345/660; 382/256–257

(56) References Cited

U.S. PATENT DOCUMENTS 4,720,745 A 1/1988 DeForest et al.
5,404,447 A 4/1995 Drako et al.
5,432,890 A 7/1995 Watanabe (List continued on next page.)

FOREIGN PATENT DOCUMENTS

EP 0 435 391 A2 7/1991
EP 1 158 485 A2 11/2001
WO WO-00/21066 A1 4/2000
WO WO-00/21067 A1 4/2000
WO 00/21068 4/2000
WO WO 00/21068 4/2000 ..... G09G/5/02
WO 01/09824 7/2000
WO WO 00/57305 9/2000 ..... G06F/17/30
WO WO 01/09824 A1 2/2001 ..... G06K/9/48
WO WO 01/09873 A1 2/2001 ..... G09G/5/02

OTHER PUBLICATIONS

Gibson Research Corporation, "Sub–Pixel Font Rendering Technology" pp 1–2 Website: http://www.grc.com; last edited Feb. 20, 2000.

(List continued on next page.)

*Primary Examiner*—Matthew C. Bella
*Assistant Examiner*—Mike Rahmjoo
(74) *Attorney, Agent, or Firm*—Darby & Darby

(57) ABSTRACT

In a display device, three light-emitting elements, which respectively emit light of the three primary colors of R, G, and B, are aligned in a fixed order in a first direction to form one pixel. A plurality of such pixels are aligned in a the direction to form one line. A plurality of such lines are aligned in a second direction, which is orthogonal to the first direction, to form a display screen. With this display device, a three-times magnified pattern, with which a target pixel in a raster image to be displayed currently is magnified by three in the first direction, is determined dynamically in accordance with a rectangular reference pattern of 3×3 pixels consisting of the target pixel and pixels surrounding the target pixel. Display is performed upon allocating this three-times magnified pattern to the three light-emitting elements that comprise one pixel. Character interval adjustment and color display of sub-pixel precision precision are enabled.

16 Claims, 17 Drawing Sheets

U.S. PATENT DOCUMENTS

| | | | | | |
|---|---|---|---|---|---|
| 5,450,208 | A | | 9/1995 | Murata | |
| 5,623,593 | A | | 4/1997 | Spells, III | |
| 5,768,490 | A | | 6/1998 | Hersch et al. | |
| 5,821,913 | A | | 10/1998 | Mamiya | |
| 5,852,443 | A | * | 12/1998 | Kenworthy | 345/441 |
| 6,008,820 | A | * | 12/1999 | Chauvin et al. | 345/502 |
| 6,243,055 | B1 | * | 6/2001 | Fergason | 345/32 |
| 6,384,839 | B1 | * | 5/2002 | Paul | 345/613 |
| 6,396,505 | B1 | * | 5/2002 | Lui et al. | 345/613 |
| 6,509,904 | B1 | * | 1/2003 | Lam | 345/613 |
| 6,542,161 | B1 | * | 4/2003 | Koyama et al. | 345/589 |

OTHER PUBLICATIONS

Gibson Research Corporation, "Sub–Pixel Font Rendering: How It Works" pp 1–9 Website: http://www.grc.com; last edited Feb. 11, 2002.

Gibson Research Corporation, "Sub–Pixel Font Rendering Technology: Implementation Details" pp 1–7; Website: http://www.grc.com; last edited Feb. 8, 1999.

Gibson, Steve: "Sub–pixel font rendering technology: implementation details" Internet, Online!, Dec. 8, 1999, pp. 1–4, XP002239840, (retrieved from the Internet: <URL:http://grc.com/cttech.htm>.

Markoff, John: "Microsoft's Cleartype Sets Off Debate on Orginality"; Internet, Online!; Dec. 7, 1998, pp. 1–4, XP002239841 (retrieved from the Internet: <URL:http://www.nytimes.../articles/07microsoft–flat.html>.

* cited by examiner

Fig. 9(a)
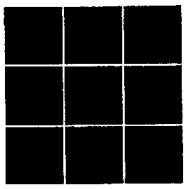
Fig. 9(b)
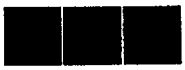
Fig. 9(c)
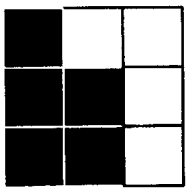
Fig. 9(d)
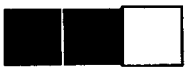
Fig. 9(e)
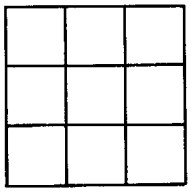
Fig. 9(f)
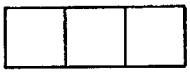
Fig. 10
| | |
|---|---|
| 000000000 | 000 |
| 001101001 | 001 |
| 111111111 | 111 |

Fig. 11(a)

| | | |
|---|---|---|
| (-1,-1) | (0,-1) | (1,-1) |
| (-1,0) | (0,0) | (1,0) |
| (-1,1) | (0,1) | (1,1) |

| |
|---|
| * |

don't care

Fig. 11(b)

| | | |
|---|---|---|
| * | * | * |
| | | |
| * | * | * |

```
if(x(-1,0)=1 and x(1,0)=1 and x(0,0)=1) then
        result := '111';
```

Fig. 11(c)

| | | |
|---|---|---|
| * | * | * |
| | | |
| * | * | * |

```
if(x(-1,0)=0 and x(1,0)=0 and x(0,0)=0) then
        result := '000';
```

Fig. 11(d)

| | | |
|---|---|---|
| * | | * |
| * | | * |
| * | | * |

```
if(x(0,-1)=1 and x(0,1)=1 and x(0,0)=1) then
        result := '111';
```

Fig. 11(e)

| | | |
|---|---|---|
| * | | * |
| * | | * |
| * | | * |

```
if(x(0,-1)=0 and x(0,1)=0 and x(0,0)=0) then
        result := '000';
```

Fig. 11(f)

| | | |
|---|---|---|
| | | |
| * | | |
| * | | |

```
if(x(-1,-1)=1 and x(0,1)=1 and x(0,0)=1
   and x(0,-1)=0 and x(1,-1)=0 and x(1,0)=0
   and x(1,1)=0) then
        result := '110';
```

Fig. 11(g)

| | | |
|---|---|---|
| | | |
| * | | |
| * | | |

```
if(x(-1,-1)=0 and x(0,1)=0 and x(0,0)=0
   and x(0,-1)=1 and x(1,-1)=1 and x(1,0)=1
   and x(1,1)=1) then
        result := '001';
```

⋮

$$V(n)=(25*V_{n-2}+60*V_{n-1}+86*V_n+60*V_{n+1}+25*V_{n+2})>>8$$

original image three-time magnified image original image three-time magnified image Prior Art

DISPLAY EQUIPMENT, DISPLAY METHOD, AND STORAGE MEDIUM STORING A DISPLAY CONTROL PROGRAM USING SUB-PIXELS

BACKGROUND OF THE INVENTION

1. Field of the Invention

This invention concerns a display equipment, which performs display at sub-pixel precision based on an original image, which is not a vector image but a raster image (pixel precision: in the case of a font, means not a vector font but a raster font), and art related to this display equipment.

2. Description of the Related Art

Display equipment that employs various types of display devices is in common use. Such display devices include color LCD's, color plasma displays, and other display devices, in which three light-emitting elements, which respectively emit light of the three primary colors of R, G, and B, are aligned in a fixed order to form one pixel. A plurality of the pixels thus formed are aligned in a first direction to form one line. A plurality of lines are aligned in a second direction, which is orthogonal to the first direction, to form a display screen of the display device.

There are also many display devices having relatively narrow display screens which make detailed display difficult to achieve. Such narrow display screens may be found in portable telephones, mobile devices, computers, etc. When an attempt is made to display a small character, photograph, or complex picture, etc. on a small display device, part of the image tends to become smeared and unclear.

To solve the above problem, attempts have been made to display in sub-pixel units. A sub-pixel unit is defined as one of the three light-emitting units. Improved picture quality may be achieved by separately driving the three light-emitting elements for R, G, and B of the pixel.

Literature (titled: "Sub-pixel Font Rendering Technology") concerning sub-pixel display, discloses on the Internet a system which uses one pixel formed by the three light-emitting elements for R, G, and B to improve the clarity of the display on a narrow screen. The present inventors have checked this literature upon downloading it from the site, http://grc.com, or its subordinate.

This art is described with reference to FIGS. 24 to 28. In the following description, the image of the alphabetic character, "A", is used as an example of the image to be displayed.

FIG. 24 is a schematic view of a single line in which single pixels are formed from three light-emitting elements as described above. The horizontal direction in FIG. 24 (the direction in which the light-emitting elements of the three primary colors of R, G, and B are aligned) is defined as the first direction. The orthogonal, vertical direction is defined as the second direction. The definition of directions is arbitrary, and is for purposes of description, without the intention to limit the present invention. The order of alignment of the light-emitting elements besides R, G, and B is possible, and this prior art and this invention can be applied in the same way described even if the order of alignment is changed.

A plurality of pixels (sets of three light-emitting elements) are aligned in a single row in the first direction to form a single line. A plurality of lines are aligned in the second direction to form the display screen.

With this sub-pixel technology, the original image is, for example, an image such as shown in FIG. 25. In this example, the character, "A", is displayed over an area having seven pixels in the horizontal direction and seven pixels in the vertical directions. Where each of the R, G, and B light-emitting elements is handled as a single pixel to perform sub-pixel display, a font, which has a definition of three times that of the above-described image in the horizontal direction, is prepared, as shown in FIG. 26, over an area consisting of 21 (=7×3) pixels in the horizontal direction and 7 pixels in the vertical direction.

Then as shown in FIG. 27, a color is determined for each of the pixels in FIG. 25 (i.e., not the pixels of FIG. 26 but the pixels of FIG. 25). However, since color irregularities will occur if display is performed as it is, a filtering process, using factors such as shown in FIG. 28(*a*), is applied. Factors concerning the luminance are shown in FIG. 28, and the luminance values of the respective pixels are adjusted by multiplying a factor, for example, of 3/9 in the case of the central target pixel, 2/9 in the case of an adjacent pixel, and 1/9 in the case of the pixel next to the adjacent pixel.

When such a filtering process is applied to pixels of the colors shown in FIG. 27, blue is adjusted to light blue, yellow is adjusted to light yellow, red is adjusted to light red, and cyan is adjusted to light cyan as shown in FIG. 28(*b*).

An image to which such a filtering process has been applied is then allocated to the respective light-emitting elements of FIG. 26 to perform sub-pixel display.

(First Problem)

With this prior art, an image (FIG. 26), which is magnified by three in definition in the first direction with respect to the original image (FIG. 26), must be retained separately and yet statically.

Generally, with fonts or other sets of numerous images, simply increasing the types of fonts requires increasing the system resource. In particular, an art that requires large system resources is difficult to employ in a portable telephone, mobile computer, etc. where there are several limitations in terms of system resource.

Furthermore, since the art is premised on the ability to statically use the three-time magnified image itself, a display, with which the definition has been magnified by three, cannot be performed, for example, for a facial portrait image or other arbitrary image that has been downloaded from a server.

The prior art has the above-described first problem that, although sub-pixel precision display is not impossible, the burden placed on the system resources is large and the range in which sub-pixel display can be performed is limited.

(Second Problem)

Also, with the prior art, there is a difficulty in terms of adjustment of the character intervals. This point is described by way of the example shown in FIG. 16. The drawing illustrates schematically a sub-pixel display by the prior art. In this example, the character string, "This", is displayed.

The respective characters (that is, the "T", "h", "i", and "s") are formed of sub-pixels as shown at the left side of FIG. 16 or as previously prepared font arranged in sub-pixels. Four sub-pixel images are thus obtained for the four characters, "T", "h", "i", and "s", respectively.

With the prior art, the images of the respective characters are aligned and displayed as shown at the right side of FIG. 16.

However with the prior art, the positions of these four images are set in pixel units and cannot be adjusted more finely. Also, although the four images of "T", "h", "i", and "s" are sub-pixel images, the spaces between these images are not sub-pixel images. There is thus the second problem that when viewed as a whole, a character string, such as "This", is not fixed in pitch and was thus non-uniform.

Also, in the case of a format such as equal spacing (similar to typewriter spacing), which is shown in FIG. 17(*a*), since the character intervals can only be adjusted at pixel precision, the character intervals tend to be non-uniform.

(Third Problem)

The prior-art display method enables only a binary black-white display (or a gray-scale display of low gradation) and cannot accommodate the case where at least one of the foreground or background is in color.

OBJECTS AND SUMMARY OF THE INVENTION

A first object of the present invention is to resolve the above-described first problem by providing a display equipment and related art that enables sub-pixel display with a light system resource load even when a three-times magnified image is not known in advance.

A second object of this invention is to resolve the above-described second problem by providing a display equipment, with which character strings can be formatted in a finer manner and which enables displays that excels in uniformity as a whole.

A third object of this invention is to resolve the above-described third problem by providing a display method at sub-pixel precision that enables color display.

(1) In order to achieve the first object, a display equipment of a first mode of this invention is equipped with a display device, in which three light-emitting elements, which respectively emit light of the three primary colors of R, G, and B, are aligned in a fixed order to form one pixel, the pixels are aligned in a first direction to form one line, and a plurality of such lines are aligned in a second direction, which is orthogonal to the first direction, to form the display screen, a display image storage means, which stores display image information to be displayed on the display device, and a display control means, which controls the display device to perform display based on the display image information stored by the display image storage means.

The display device has an original image data storage means, which stores a raster image to be displayed currently, and a three-times magnified pattern determination means, which, based on the raster image in the original image data storage means, determines a three-times magnified pattern with which the definition is magnified by three in the first direction, and the display image information, based on the three-times magnified pattern determined by the three-times magnified pattern determination means, is stored in the display image storage means.

The three-times magnified pattern determination means determines a three-times magnified pattern, with which a target pixel, in the raster image stored in the original image data storage means, is magnified by three in the first direction, in accordance with a rectangular reference pattern of a total of $(2n+1)\times(2m+1)$ (where n and m are natural numbers) pixels consisting of the target pixel and the pixels that surround the target pixel, and the display control means controls the display device to perform display upon allocating the three-times magnified pattern to the three light-emitting elements that comprise one pixel.

With this arrangement, since the three-times magnified pattern determination means dynamically determines the three-times magnified pattern based on the raster image stored in the original image data storage means, the three-times magnified pattern does not have to be retained statically. Thus in comparison to the case where the three-times magnified pattern is stored statically, the burden placed on the system is lightened to enable application to portable telephones, mobile computers, and other equipment with severe limitations in system resource.

The raster image and the three-times magnified pattern for the raster image need not be known in advance. Thus for a wide range of images, such as a facial portrait image that has been downloaded from a server, a sub-pixel image, which is improved in definition in a practical way, is displayed in a manner that is easy to view.

With a display equipment of a second mode of this invention, n=1 and m=1.

With this arrangement, the reference pattern is a rectangular, 3×3 pixel set, the reference pattern can take any of 512 forms, and sub-pixel display is realized using a simple process.

With a display equipment of a third mode of this invention, the raster image stored in the original image data storage means is a bit map font, a bit map image, formed by raster development of a vector font, or a raster image that is not a font.

By this arrangement, sub-pixel display is performed for images of various forms.

With a display equipment of a fourth mode of this invention, the three-times magnified pattern determination means references a reference pattern storage means which stores according to three-times magnified pattern determination rules, to determine the three-times magnified pattern.

With this arrangement, since the three-times magnified pattern is determined upon referencing the reference pattern storage means, the three-times magnified pattern is determined at high speed and the display response is improved.

With a display equipment of a fifth mode of this invention, information for pattern matching of the reference pattern is stored in the reference pattern storage means.

By this arrangement, the three-times magnified pattern is determined by pattern matching.

With a display equipment of a sixth mode of this invention, a bit string, which expresses the reference pattern in the form of bits, and information indicating a three-times magnified pattern for this bit string, are stored in an associated manner in the reference pattern storage means.

With this arrangement, a three-times magnified pattern is searched rapidly and readily using the bit string.

With a display equipment of a seventh mode of this invention, the three-times magnified pattern determination means determines the three-times magnified pattern by referencing the calculation results of a three-times magnified pattern logical operation means, which performs logical operations based on the reference pattern.

By this arrangement, since the three-times magnified pattern is determined only by logical operations even if the reference pattern is not stored, savings in storage area is achieved.

(2) In order to achieve the second object, a display equipment of an eighth mode of this invention is equipped with a display image storage means, which stores a display image, a display means, with which three light-emitting elements, which respectively emit light of the three primary colors of R, G, and B, are aligned in a fixed order to comprise one pixel and which performs display based on the display image stored in the display image storage means, a character string storage means, which stores a character string to be displayed, a format information storage means, which stores format information on the respective characters of the character string to be displayed, a character string image generating means, which generates, based on the format information, a character string image in which the character string stored by the character string storage means is formatted in an integral manner, a sub-pixel image generating means, which generates a sub-pixel image, with which the generated character string image is mapped at the level of the light-emitting elements, and stores the sub-pixel image in the display image storage means, and a control means, which allocates the sub-pixel image in the display image storage means to the respective light-emitting elements and makes the display means perform display.

By this arrangement, a character format, which is based on one-pixel units in the prior art, is displayed more finely at sub-pixel precision. Here, though a display result is generally poorer in definition than a printed result, this difference in definition is reduced by the sub-pixel display to improve the WYSIWYG (What you see is what you get) feature.

In particular, since sub-pixel mapping is performed at the level of the character string image itself, in which a character string is formatted integrally, sub-pixel mapping is performed not only on the characters that comprise the character string but also on the intervals between characters. The precision of character intervals is thus improved and the pitch is made constant for the character string as a whole to enable a display of high uniformity.

A display equipment of a ninth mode of this invention is equipped with a filtering process means, which transfers to the sub-pixel image generating means, information on the energy collection of the character string image, generated by the character string image generating means, among the respective light-emitting elements that comprise a single pixel and/or light-emitting elements adjacent to the above-mentioned light-emitting elements.

By this arrangement, suitable factors for performing filtering are selected to perform appropriate energy collection from among the respective light-emitting elements and to thereby realize a display that is easy to view.

With a display equipment of a tenth mode of this invention, the character string is a word, row, column, or paragraph.

With this arrangement, various character forms are handled at sub-pixel precision.

With a display equipment of an eleventh mode of this invention, the format information concerns kerning, both-end equal spacing, right justify, left justify, or centering.

By this arrangement, various formats are handled at sub-pixel precision.

(3) In order to achieve the third object, a twelfth mode of this invention provides a display method, by which a display device, in which three light-emitting elements, which respectively emit light of the three primary colors of R, G, and B, are aligned in a fixed order to form one pixel, such pixels are aligned in a first direction to form one line, and a plurality of such lines are aligned in a second direction, which is orthogonal to the first direction, to form the display screen, is made to perform display. The display method includes a step of acquiring three-times magnified image data, consisting of sub-pixels resulting from the magnification of a raster image to be currently displayed by three in the first direction, a step of subjecting the three-times magnified image data to a filtering process, a step of determining, on the basis of the filtering process results, a mixing ratio of the foreground color and the background color of each pixel, a step of acquiring the foreground colors and the background colors of the respective pixels, a step of determining a mixed color, in which the foreground color and background color are mixed at the sub-pixel level, for each pixel in accordance with the determined mixing ratio, and a step of controlling the display device to perform color sub-pixel display in accordance with the mixed color.

By this arrangement, sub-pixel display is performed not only for a black and white display but also where either or both the foreground and background are in color. Thus even in the case of color display, the display is made easy to view, the smearing of characters is limited, and the clarity of the display is improved by sub-pixel display.

With a display method of a thirteenth mode of this invention, the mixing ratio is determined by normalizing the values resulting from filtering.

By this arrangement, the filtering results are incorporated accurately in the mixed color.

With a display method of a fourteenth method of this invention, the foreground color value, background color value, and mixing ratio are expressed in 8 bits.

By this arrangement, computer operations are facilitated and the ease of use by one skilled in the art is improved.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 5(*b*) is an example diagram of an extracted pattern of the first embodiment of this invention.

FIG. 5(*c*) is an example diagram of a three-times magnified pattern of the first embodiment of this invention.

FIGS. 9(*a*), (*c*), and (*e*) are example diagrams of reference patterns of the first embodiment of this invention.

FIGS. 9(*b*), (*d*), and (*f*) are example diagrams of three-times magnified patterns of the first embodiment of this invention.

FIG. 10 is a diagram that shows the relationship between a bit string and a three-times magnified pattern of the first embodiment of this invention (modification example).

FIG. 11(*a*) is a definition diagram of a reference pattern of the second embodiment of this invention.

FIGS. 11(*b*), (*c*), (*d*), (*e*), (*f*), and (*g*) are diagrams that show the relationship between a reference pattern and a three-times magnified pattern of the second embodiment of this invention.

FIG. 17(*b*) is an example diagram of a display of the third embodiment of this invention.

FIG. 28(*b*) is an example diagram of the filtering process results of the prior art.

FIG. 29(*b*) is an example diagram of a three-times magnified image of the prior art.

FIG. 29(*c*) is an explanatory diagram of the filtering process of the prior art.

DETAILED DESCRIPTION OF THE PREFERRED EMBODIMENTS (First Embodiment)

Figure 1:
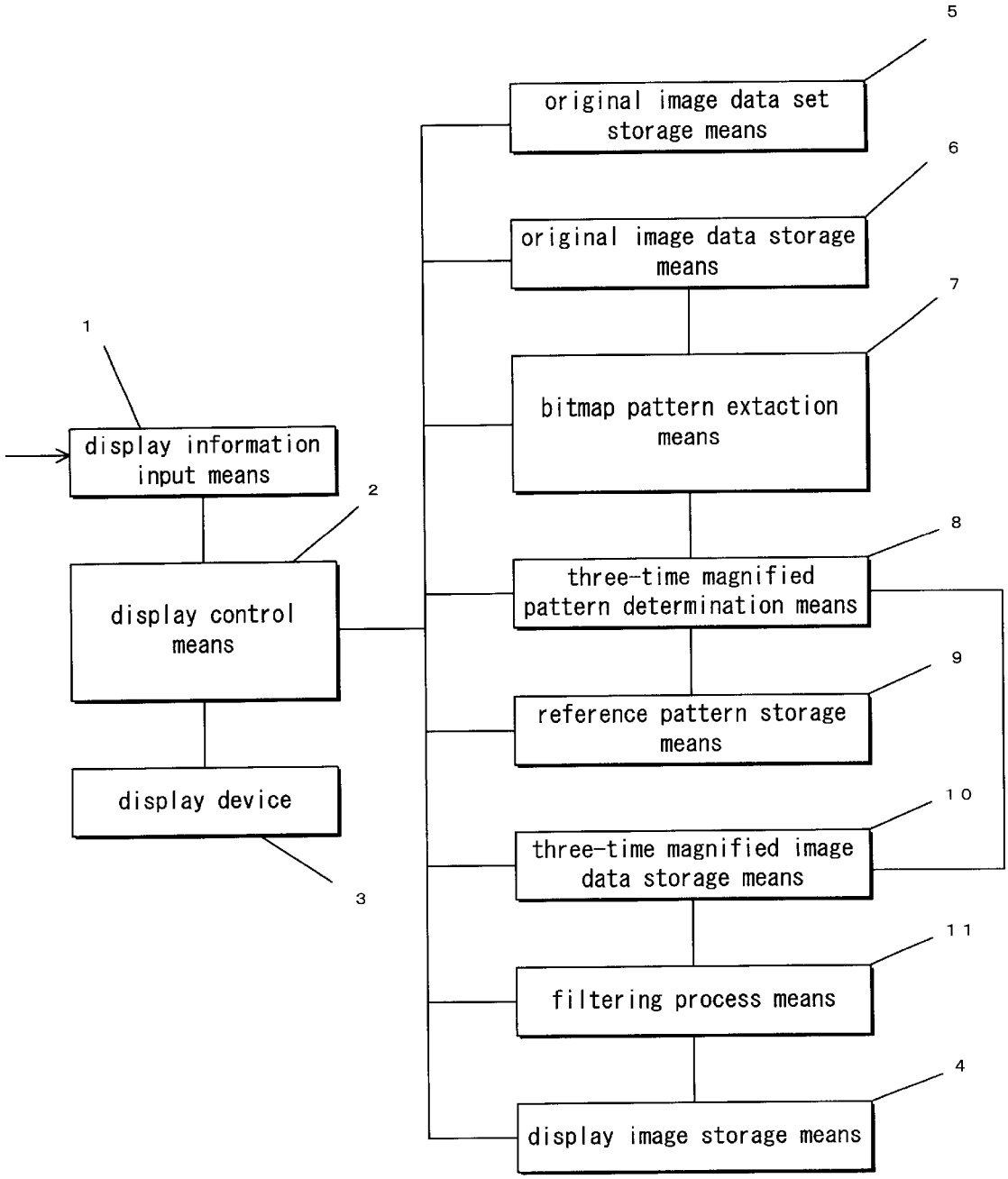
FIG. 1 is a block diagram of a display equipment according to a first embodiment of this invention.

Referring to FIG. 1, a display information input means 1, of a first embodiment, receives display information. A display control means 2 controls the various elements of FIG. 1 to display a display image on a display device 3. The display is created from the display information stored in a display image storage means 4 (VRAM, etc.).

The display device 3 employs sets of three light-emitting elements, which respectively emit light of the three primary colors of R, G, and B. The three light-emitting elements of a set are aligned in a fixed order to form one pixel. A plurality of pixels thus formed are aligned in a first direction to form one line. A plurality of such lines are aligned in a second direction, which is orthogonal to the first direction, to form the display screen. To be more specific, the display device 3 is a color LCD or color plasma display, etc., including a suitable driver for driving the respective elements of the color LCD or color plasma display, etc.

An original image data set storage means 5 stores a set of original image data, such as font data. This font may be one or both of a raster font and a vector font.

An original image data storage means 6 temporarily stores the original image data received from the display information input means 1. Where the original image data set storage means 5 stores raster font data and the display information input means 1 inputs an instruction indicating that specific raster font data in the original image data set storage means 5 are to be displayed, the display control means 2 stores the current raster font data of the original image data set storage means 5 directly as the original image data in the original image data storage means 6.

When the original image data set storage means 5 holds vector font data and the display information input means 1 inputs an instruction indicating that specific vector font data are to be displayed, the display control means 2 develops the vector font data in a predetermined area to generate a raster image and stores this raster image as the original image in the original image data storage means 6.

When a general raster image is required by the input from the display information input means 1, which is not stored in the original image data set storage means 5, the display control means 2 develops the input raster image in a predetermined area and stores the image in the original image data storage means 6.

A bit map pattern extraction means 7 extracts a bit map pattern from the original image data stored in the original image data storage means 6. The form of this bit map pattern is the same as the form of the reference pattern that is compared to the bit map pattern.

Figure 8:
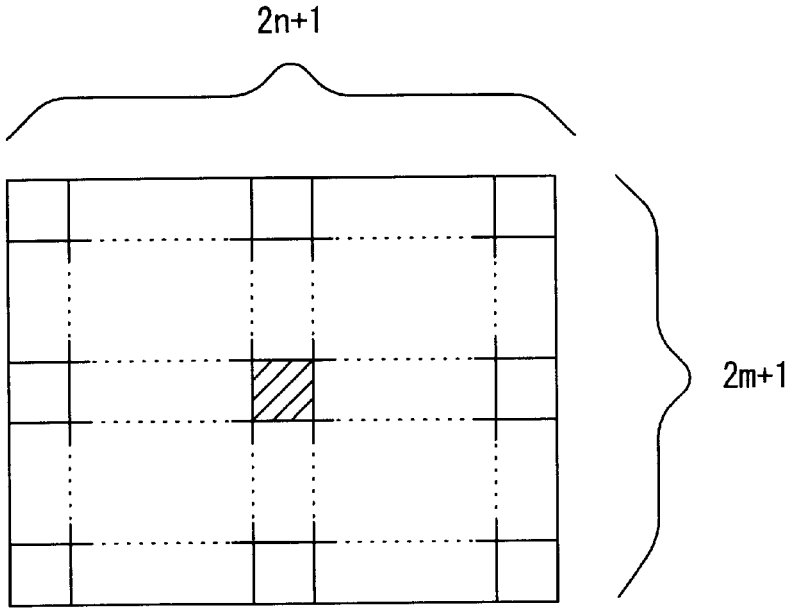
FIG. 8 is a definition diagram of a reference pattern of the first embodiment of this invention.

These patterns are generally defined as shown in FIG. 8. That is, the central pixel, indicated by the slanted lines, is the target pixel. Each pattern is a pattern of a total of $(2n+1)\times(2m+1)$ (where n and m are natural numbers) pixels consisting of the target pixel and the pixels that surround the target pixel. These patterns can take on 2 to the $(2n+1)\times(2m+1)$th power forms.

Here, in order to reduce the system resource and computation costs, it is preferable for $n=m=1$. In this case, each pattern consists of 3×3 pixels and the patterns can take on any of 512 forms. Though the case where each pattern consists of 3×3 pixels is described below, the size of the pattern may be changed to, for example, 3×5 pixels, 5×5 pixels, etc., without departing from the spirit and scope of the invention.

When this pattern of 3×3 pixels is all black as shown in FIG. 9(*a*), the three-times magnified pattern is such that the central target pixel is black and the adjacent pixels are also black as shown in FIG. 9(*b*).

On the contrary, when the pattern of 3×3 pixels is all white as shown in FIG. 9(*e*), the three-times magnified pattern is such that the central target pixel of the three-times is white and the adjacent pixels are also white as shown in FIG. 9(*f*).

The rules for determining three-times magnified patterns for the various possible patterns that are intermediate the above two patterns are established in advance. In this case, though there will be 512 rules if a rule is to be established for each pattern form. Fewer than 512 rules are needed if symmetry and black-white inversion are taken into account.

Although the above concerns a first example of pattern matching, this is expressed in the form of bits and modified as follows.

That is, by expressing black as "0" and white as "1" as shown in FIG. 10, the black and white coloration of the 3×3 pixels is expressed, in the order starting from the upper left corner of the 3×3 pixels and ending at the lower right corner, as a bit string (9 digits) of "0" or "1".

A pattern of 3×3 pixels, which is all black as shown in FIG. 9(*a*), can then be expressed by the bit string, "000000000". The corresponding three-times magnified pattern is "000".

On the contrary, a pattern of 3×3 pixels, which is all white as shown in FIG. 9(*e*), is expressed by the bit string, "111111111". The corresponding three-times magnified pattern is "111".

As with the prior described case, when patterns are to be expressed using such bit strings, rules for determining three-times magnified patterns are established in advance for the various possible patterns that are intermediate the bit string, "000000000", and the bit string, "111111111". In this case, although there would be 512 rules if a rule is required for each pattern form as has been mentioned above, the patterns are handled by fewer than 512 rules if part of the rules are eliminated by taking symmetry and black-white inversion into account.

Returning now to FIG. 1, the rules for bit patterns are stored in a reference pattern storage means 9 using the bit strings as indices and using arrays or other known forms of storage structures for association. When a bit string contains an index which indicates that a particular reference pattern is requested, the three-times magnified pattern that is requested is immediately available from the reference pattern storage means 9.

As has been mentioned above, reference patterns and three-times magnified patterns are stored in an associated manner in the reference pattern storage means 9.

The described method of expressing the patterns may be replaced by other equivalent expression methods, such as the hexadecimal expression of the 9-digit bit strings.

A three-times magnified pattern determination means 8 references the reference pattern storage means 9 and determines the three-times magnified pattern by search by pattern matching as shown in FIG. 9 or by using an index as shown in FIG. 10.

A three-times magnified image data storage means 10 stores the three-times magnified image, determined by the three-times magnified pattern determination means 8, for the data of one original image.

A filtering process means 11 performs a filtering process, such as that described in the section concerning the prior art, on the three-times magnified image stored in the three-times magnified image data storage means 10 and stores the image resulting from this process in the display image storage means 4.

Figure 2:
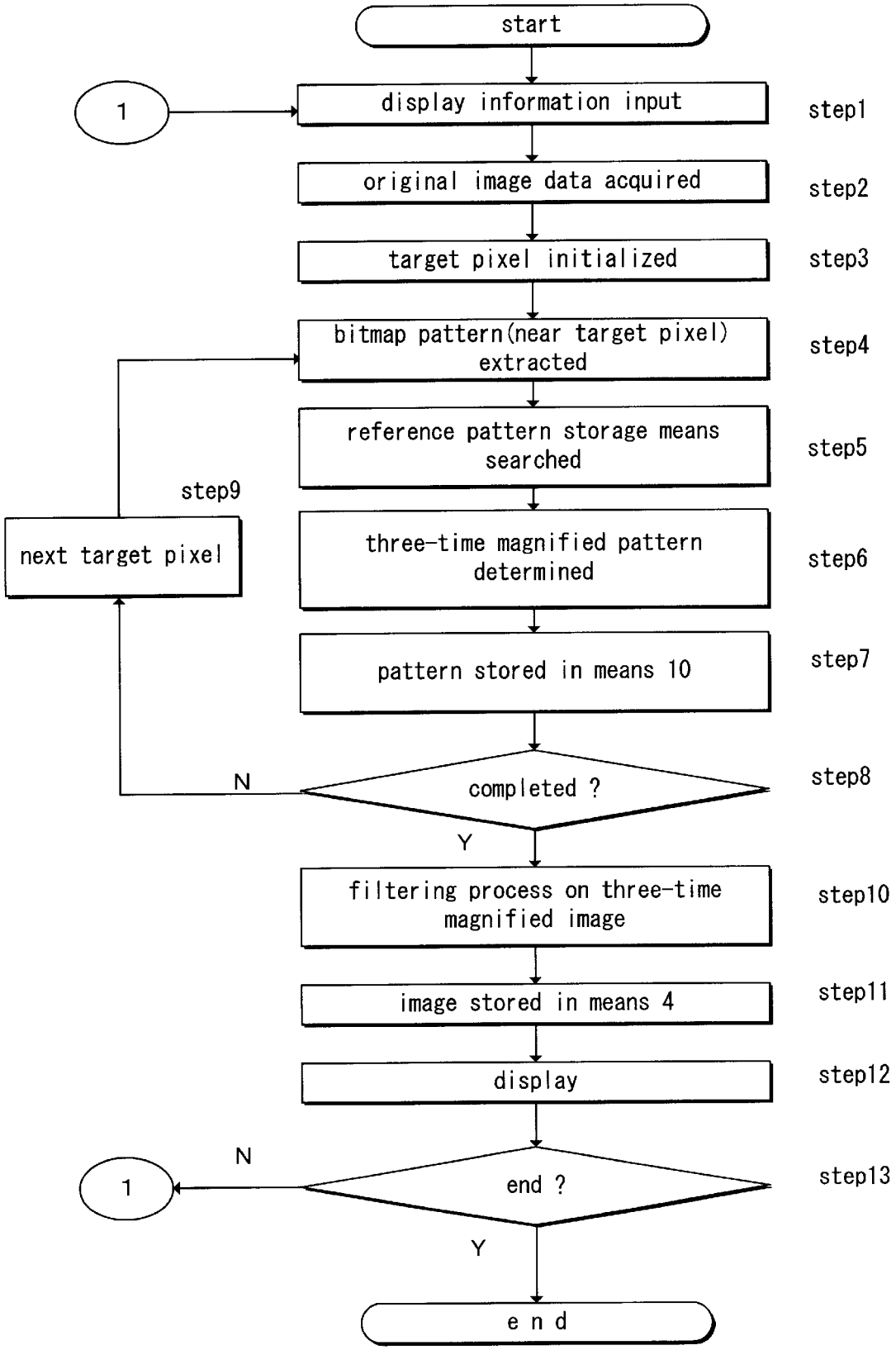
FIG. 2 is a flowchart of the display equipment of the first embodiment of this invention.

Referring now also to the flow chart in FIG. 2, in step 1, the display information is input into the display information input means 1.

When an instruction is received from the display information input means 1, indicating that specific raster font data in the original image data set storage means 5 are to be displayed, the display control means 2 stores the current raster font data of the original image data set storage means 5 directly as original image data in the original image data storage means 6.

When the display information input means 1 receives an instruction indicating that a specific vector font data are to be displayed, the display control means 2 develops the vector font data in a predetermined area to generate a raster image and stores this raster image as the original image in the original image data storage means 6.

When a general raster image, which is not stored in the original image data set storage means 5, is input from the display information input means 1, the display control means 2 develops the input raster image in a predetermined area and stores the image in the original image data storage means 6 (step 2).

Next in step 3, the display control means 2 initializes the target pixel of the bit map pattern extraction means 7 to the initial position at the upper left (step 3) and instructs the bit map pattern extraction means 7 to perform bit map pattern extraction for the case where the target pixel is at the initial position.

The bit map pattern extraction means 7 then extracts, from the original image in the original image data storage means 6, the bit map pattern for the case where the target pixel is at the initial position and returns this pattern to the display control means 2 (step 4). For example, if the slanted line part shown in FIG. 5(*a*) is the target pixel, the bit map pattern extraction means 7 extracts the bit map pattern shown in FIG. 5(*b*).

Upon receiving the bit map pattern from the bit map pattern extraction means 7, the display control means 2 transfers this pattern to the three-times magnified pattern determination means 8 and instructs the determination of the three-times magnified pattern that is appropriate for this bit map pattern.

The three-times magnified pattern determination means 8 then searches the three-times magnified pattern determination rules in the reference pattern storage means 9 to determine the reference pattern that is appropriate for the bit map pattern that was received and then determines the three-times magnified pattern that corresponds to the determined reference pattern and stores this three-times magnified pattern in the three-times magnified image data storage means 10.

Figure 5A:
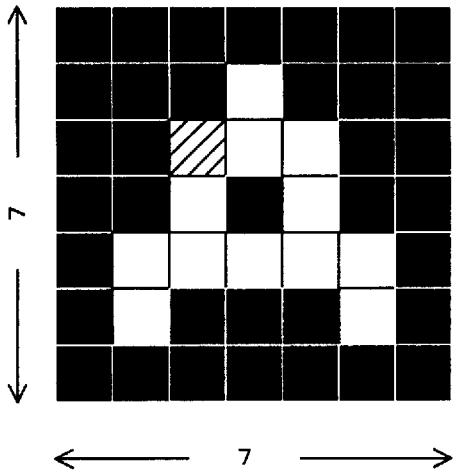
FIG. 5(*a*) is an example diagram of an original image of the first embodiment of this invention.
Figure 5B:
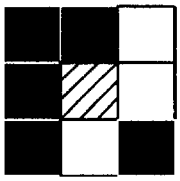
Figure 5C:
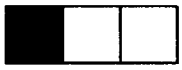

That is, for example, the three-times magnified pattern determination means 8 determines the reference pattern that matches the bit map pattern of FIG. 5(*b*), determines the three-times magnified pattern, shown in FIG. 5(*c*), that corresponds to this reference pattern, and stores this three-times magnified pattern in the three-times magnified image data storage means 10.

The display control means 2 repeats the processes from step 4 to step 7 while renewing the target pixel (step 9) until the process is completed for all target pixels (step 8). Thus as the three-times magnified pattern determination means 8 successively stores the three-times magnified patterns, the information corresponding to the image shown in FIG. 6 becomes stored in the three-times magnified image data storage means 10.

When these repeated processes are completed, the display control means 2 commands the filtering process means 11 to perform a filtering process on the three-times magnified image data in the three-times magnified image data storage means 10 (step 10). The filtering process means 11 stores the processed image in the display image storage means 4 (step 11).

Then based on the display image stored in the display image storage means 4, the display control means 2 allocates the three-times magnified pattern to the three light-emitting elements that comprise one pixel of the display device 3 and makes the display device 3 perform display (step 12).

Figure 6:
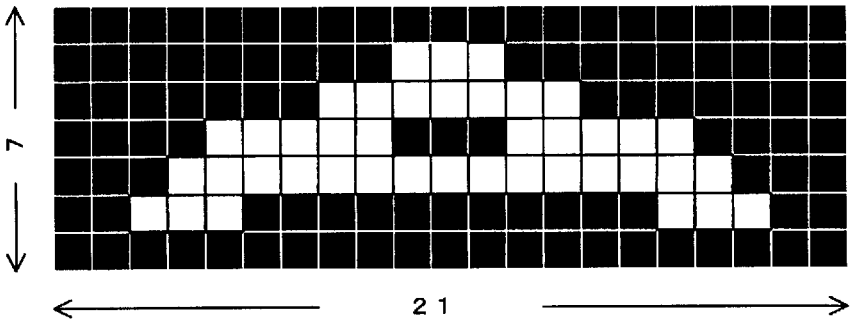
FIG. 6 is an example diagram of a three-times magnified image of the first embodiment of this invention.
Figure 7:
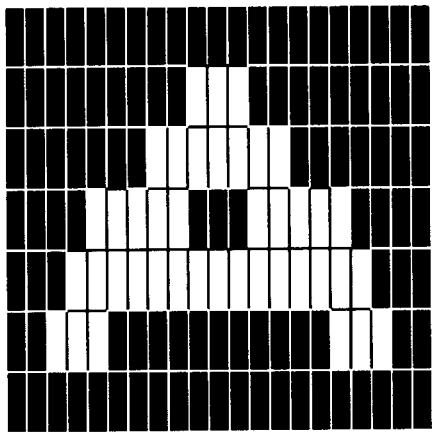
FIG. 7 is an example diagram of a sub-pixel display of the first embodiment of this invention.

For the example shown in FIG. 6, the display is as shown in FIG. 7. From a comparison of FIG. 7 and FIG. 5(*a*), it can be understood that the display of FIG. 7 is less jaggy and is thus far easier to view.

If the display is not completed at step 13, the display control means 2 returns the process to step 1.

(Second Embodiment)

Figure 3:
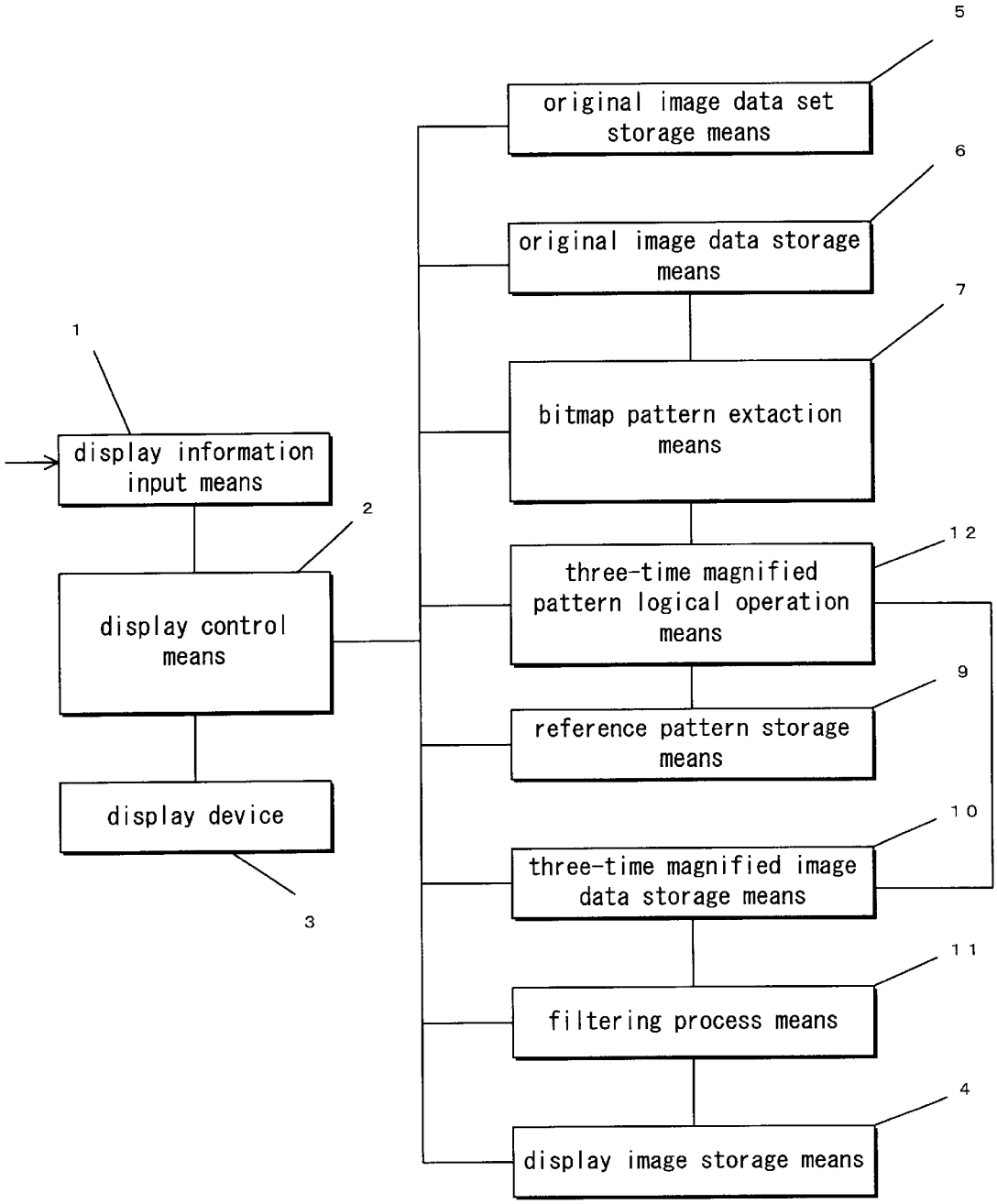
FIG. 3 is a block diagram of a display equipment according to a second embodiment of this invention.

Referring now to FIG. 3, a second embodiment of the invention is similar to the first embodiment of FIG. 1, except that the three-times magnified pattern determination means 8 is replaced by a three-times magnified pattern logical operation means 12. Because most of the elements and operations of the embodiment in FIG. 3 are identical to corresponding elements in FIG. 1, only the differences are described. FIG. 3 is a block diagram of the display equipment of the second embodiment of this invention. Unlike the first embodiment, the three-times pattern determination rules are not stored but are determined by a logical operation process in the present embodiment.

Referring now to FIGS. 11(*a*)–(*g*), the logical operation performed by the three-times magnified pattern logical operation means 12 uses functions that make the conditional decisions shown in FIG. 11(*b*) onwards on the central target pixel (0, 0) and the adjacent pixels (total of 3×3 pixels) shown in FIG. 11(*a*). In accordance with the decision result, the three-times magnified pattern logical operation means 12 returns, as a return value, the 3-digit bit value that determines the three-times magnified pattern. Here, the "*" in FIG. 11(*b*) onwards indicates that a pixel may be either black or white.

For example, if the target pixel and the pixels at both sides are all black as shown in FIG. 11(*b*), the return value is "111". Also, if as shown in FIG. 11(*c*), the target pixel and the pixels at both sides are all white, the return value is "000".

In addition, the three-times magnified pattern logic operation means 12 is provided with the logic that enable the operation processes of FIGS. 11(*d*), (*e*), (*f*), (*g*), It will be understood that, like the first embodiment, the second embodiment also determine the three-times magnified pattern, but uses a slightly different process to do so. Also, the second embodiment is incorporated more readily in equipment with severe restrictions in memory area since the determination of the pattern is performed by operation processes and does not require as much storage area.

Figure 4:
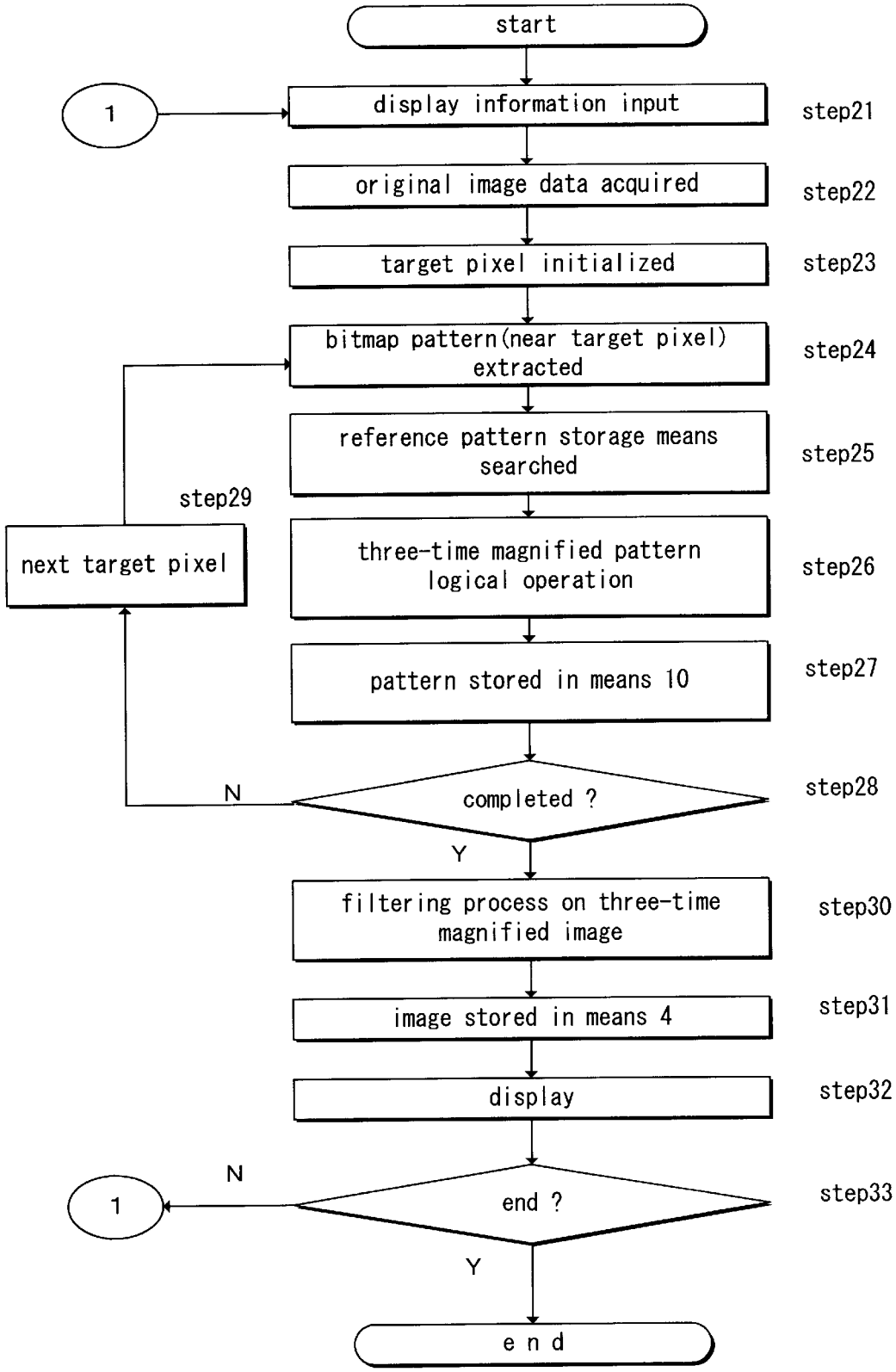
FIG. 4 is a flowchart of the display equipment of the second embodiment of this invention.

The flow of the processes using the display equipment of FIG. 3 is now described with reference to FIG. 4. First in step 21, the display information is input to the display information input means 1.

When an instruction, indicating that specific raster font data in the original image data set storage means 5 are to be displayed, is input from the display information input means 1, the display control means 2 stores the current raster font data of the original image data set storage means 5 directly as original image data in the original image data storage means 6.

When the display information input means 1 inputs an instruction indicating that a specific vector font data are to be displayed, the display control means 2 develops the vector font data in a predetermined area to generate a raster image and stores this raster image as the original image in the original image data storage means 6.

When a general raster image, which is not stored in the original image data set storage means 5, is input from the display information input means 1, the display control means 2 develops the input raster image in a predetermined area and stores the image in the original image data storage means 6 (step 22).

Next in step 23, the display control means 2 initializes the target pixel of the bit map pattern extraction means 7 to the initial position at the upper left (step 23) and instructs the bit map pattern extraction means 7 to perform bit map pattern extraction for the case where the target pixel is at the initial position.

The bit map pattern extraction means 7 then extracts, from the original image in the original image data storage means 6, the bit map pattern for the case where the target pixel is at the initial position and returns this pattern to the display control means 2 (step 24).

Upon receiving the bit map pattern from the bit map pattern extraction means 7, the display control means 2 transfers this pattern to the three-times magnified pattern determination means 8 and commands the determination of the three-times magnified pattern that is appropriate for this bit map pattern.

The three-times magnified pattern determination means 8 then makes the three-times magnified pattern logical operation means 12 perform logical operations such as those described above and acquires the return value. The three-times magnified pattern determination means 8 then stores the three-times magnified pattern that corresponds to the return value in the three-times magnified image data storage means 10.

The display control means 2 repeats the processes from step 24 to step 27 while renewing the target pixel (step 29) until the process has been completed for all target pixels (step 28). When these repeated processes are completed, the display control means 2 commands the filtering process means 11 to perform a filtering process on the three-times magnified image data in the three-times magnified image data storage means 10 (step 30). The filtering process means 11 then stores the processed image in the display image storage means 4 (step 31).

Then based on the display image stored in the display image storage means 4, the display control means 2 allocates the three-times magnified pattern to the three light-emitting elements that comprise one pixel of the display device 3 and makes the display device 3 perform display (step 32).

If the display is not completed (step 33), the display control means 2 returns the process to step 21.

One skilled in the art will recognize that an arrangement that combines the first embodiment and the second embodiment also falls within the scope of this invention. For example, a two-stage process, using the reference pattern storage means 9 together with the three-times magnified pattern logical operation means 12 is performed, would fall within the scope of the invention. The process using the reference pattern storage means 9 and the process using the three-times magnified pattern logical operation means 12 may be performed in any order.

The first and second embodiments provide the following effects.

These embodiments can be applied to equipment with severe system resource limitations without statically retaining the three-times magnified pattern since the three-times magnified pattern is determined dynamically. Moreover, with regard to the display image, the embodiments can handle not just raster fonts but also images of various forms and can realize a sub-pixel display that is easy to view even on a narrow display screen. These embodiments are especially high in practicality for font display.

(Third Embodiment)

Figure 12:
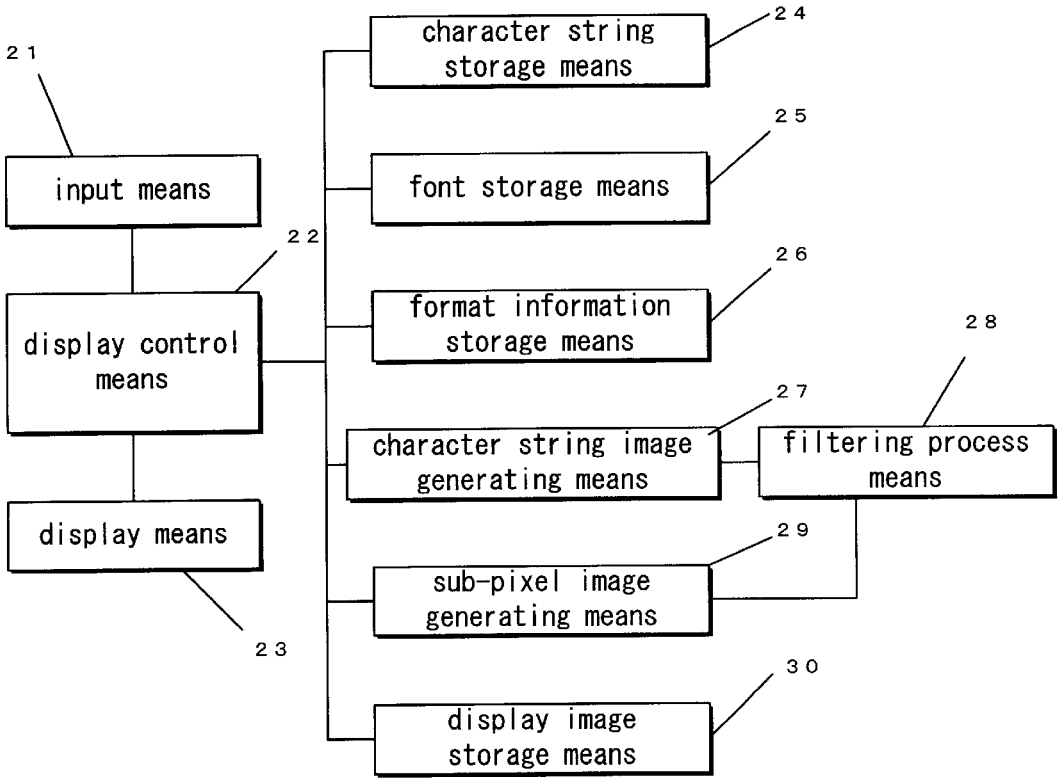
FIG. 12 is a block diagram of a display equipment according to a third embodiment of this invention.

The third embodiment of the invention, for achieving the second object, is now disclosed with reference to FIG. 12. An input means 21, which may be, for example, a keyboard or mouse, etc., accepts the input of character strings to be displayed, operation instructions, etc. A display control means 22 controls the various elements shown in FIG. 12 in accordance with the flowchart of FIG. 14. In particular, the display control means 22 allocates the sub-pixel image in a display image storage means 30 to the respective light-emitting elements of a display means 23 and thereby enables the display means 23 to perform display.

A character string storage means 24 stores the character string to be displayed. A font storage means 25 stores various font data, which may be vector fonts or raster fonts.

A format information storage means 26 stores the format information that is referenced in the process of formatting the respective characters of the character string to be displayed. This format information may indicate kerning, both-end equal spacing, right justify, left justify, or centering or may contain position information on the respective characters. With this invention, the format information enables not single-pixel precision but the three-times finer precision of sub-pixels rather than pixel precision.

Based on the format information of the format information storage means 26, a character string image generating means 27 generates a character string image, in which the character string stored in the character string storage means 24 is formatted in an integral manner. This character string image may be an image in which a vector font is formatted as it is as vector data, an image with which a raster font of the font storage means 25 is magnified by three in the direction in which the three light-emitting elements of R, G, and B are aligned, or an image of raster data, in which the raster font stored in the font storage means 25 is formatted as it is.

The unit of the character string that is formatted integrally (in other words, becomes a single image) is selected arbitrarily from among a single character, a word, a row, a column, a paragraph (containing two or more rows), etc.

A filtering process means 28 performs a filtering process on the image generated by the character string image generating means 27 and transfers the image that is obtained as a result of this process to a sub-pixel image generating means 29. In the present embodiment, the filtering process means 28 performs a filtering process using factors in which the denominator is a power of 2.

Figure 13:
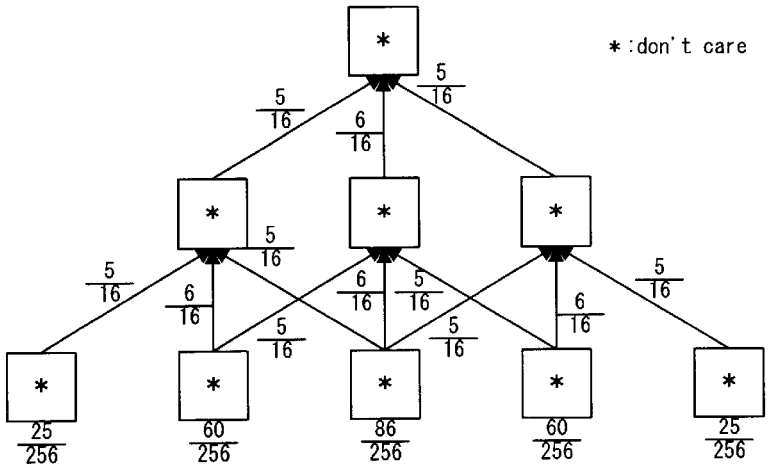
FIG. 13 is an explanatory diagram of filter factors of the third embodiment of this diagram.

A specific example of these factors is described with reference to FIG. 13. In the first stage, energy corresponding to a factor 6/16 is allocated from the central sub-pixel and energy corresponding to a factor of 5/16 is allocated from the sub-pixels to the left and right of the central pixel.

Likewise in the second stage, energy corresponding to a factor of 6/16 is allocated from the central sub-pixel and energy corresponding to a factor of 5/16 is allocated from the sub-pixels to the left and right of the central pixel.

Since the target sub-pixel can thus be reached from the first stage via a total of three paths at the center, left, and right sides of the second stage, the synthetic factor of the target sub-pixel (obtained by multiplying together the factors of the first stage and the second stage) is 86/256. Since a sub-pixel adjacent the target pixel is reached via two paths, the synthetic factor for this sub-pixel is 60/256. Since a next adjacent sub-pixel can only be reached via a single path, the synthetic factor for this sub-pixel is 25/256.

The value V(n) after the filtering process is thus:

$$V(n)=(25/256)\times V_{n-2}+(60/256)\times V_{n-1}+(86/256)\times V_n+(60/256)\times V_{n+1}+(25/256)\times V_{n+2}=(25\times V_{n-2}+60\times V_{n-1}+86\times V_n+60\times V_{n+1}+25\times V_{n+2})/256$$

Here, since shifting by 8 bits performs multiplication by 1/256, the numerator $(25\times V_{n-2}+60\times V_{n-1}+86\times V_n+60\times V_{n+1}+25\times V_{n+2})$ is determined by integer multiplication and addition and then is divided by 256 by bit shifting.

Since all operations can be performed as integer operations, the operations are performed at high speed and are readily incorporated in hardware.

The sub-pixel image generating means 29 references the image data received from the filtering process means 28 (this referencing may be omitted) and generates a sub-pixel image with which the character string image generated by character string image generation means 27 is mapped at the level of the light-emitting elements of the display means 23 (that is, at sub-pixel precision). The sub-pixel image generating means 29 then stores this sub-pixel image in the display image storage means 30, which may be, for example, a VRAM.

Figure 14:
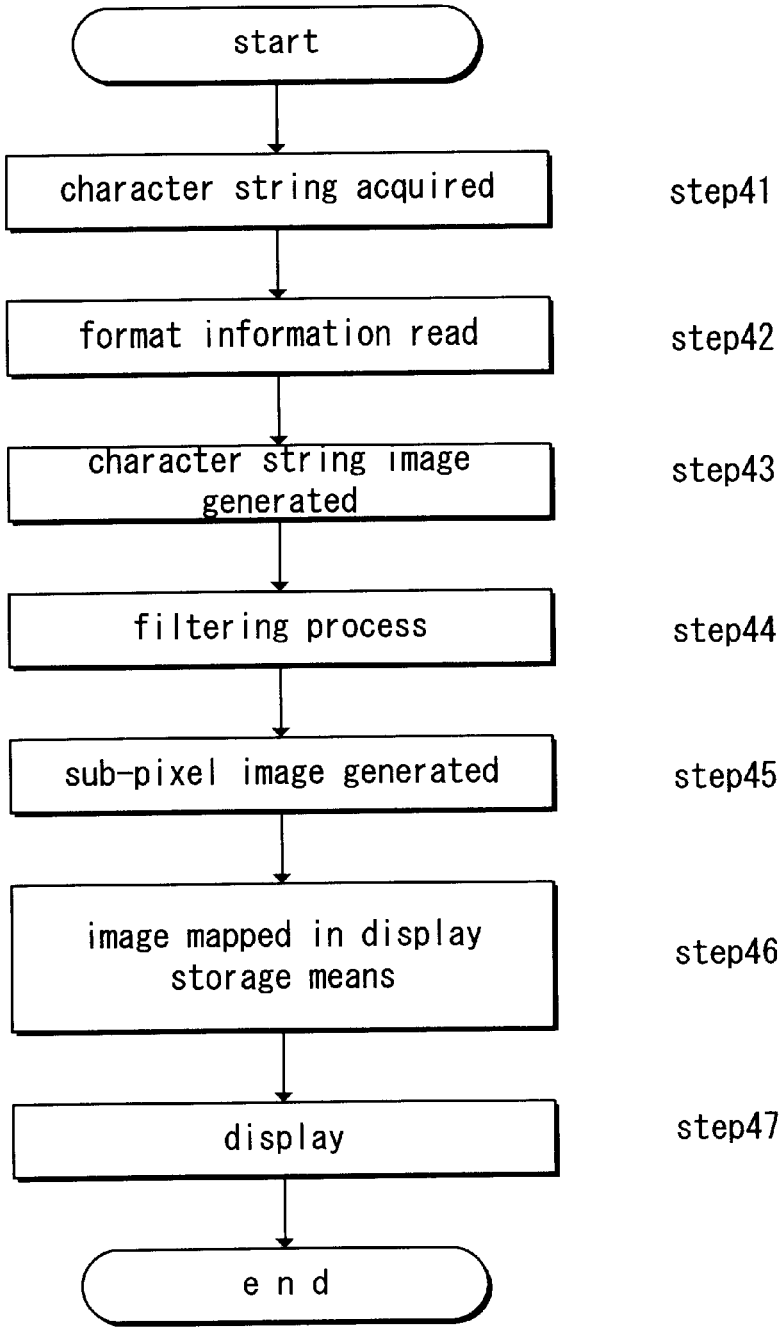
FIG. 14 is a flowchart of the display equipment of the third embodiment of this invention.

The process flow of the character display device of this embodiment is now described with reference to FIG. 14. First in step 41, the display control means 22 acquires the character string to be displayed from its storage location in the character string storage means 24. In step 42, the display control means reads the format information concerning this character string from format the information storage means 26.

In step 43, the character string and the format information are transferred to the character string image generating means 27. The character string image generating means 27 is instructed to generate a character string image. From the received data, the character string image generating means 27 generates a single character string image for a single character string and outputs this image to the filtering process means 28.

In step 44, the filtering process means 28 performs a filtering process based on the character string image generated by the character string image generating means 27 and outputs the result to the sub-pixel image generating means 29.

The sub-pixel image generating means 29 then generates a single and integral sub-pixel image for a single character string (step 45) and performs mapping at the light-emitting element level in the display image storage means 30 (step 46).

In step 47, the display control means 22 allocates the display image, stored in the display image storage means 30, to the respective light-emitting elements of the display means 23 and enables the display means 23 to display the image.

Figure 15:
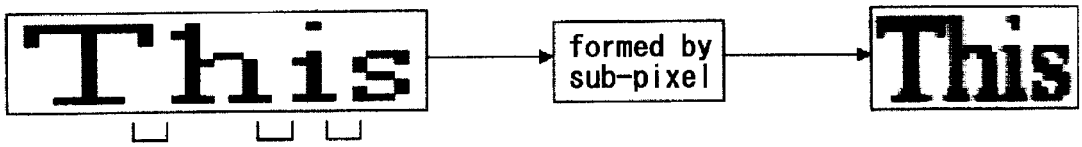
FIG. 15 is a schematic diagram of the sub-pixel display of the third embodiment of this invention.

In FIG. 15, the abovementioned sub-pixel display is shown in a schematic manner. In the example of FIG. 15, the character string "This" is to be displayed similarly as in the case of the prior art shown in FIG. 16. Prior to sub-pixel mapping, a character string, in which the "This" character string is formatted integrally, is generated based on the format information as shown at the left side of FIG. 15.

Here, for example the space between "T" and "h" is given an arbitrary character interval or character position defined in fine sub-pixel units instead of single-pixel units. This sharpens the accuracy of spacing by a factor of three. In addition, settings using units that are finer than sub-pixel units may be used in order to achieve even greater accuracy.

This character string image is then subject integrally to sub-pixel mapping to generate a single sub-pixel image, such as shown at the right side of FIG. 15. This sub-pixel image is directly displayed by the display means 23.

Figure 16:
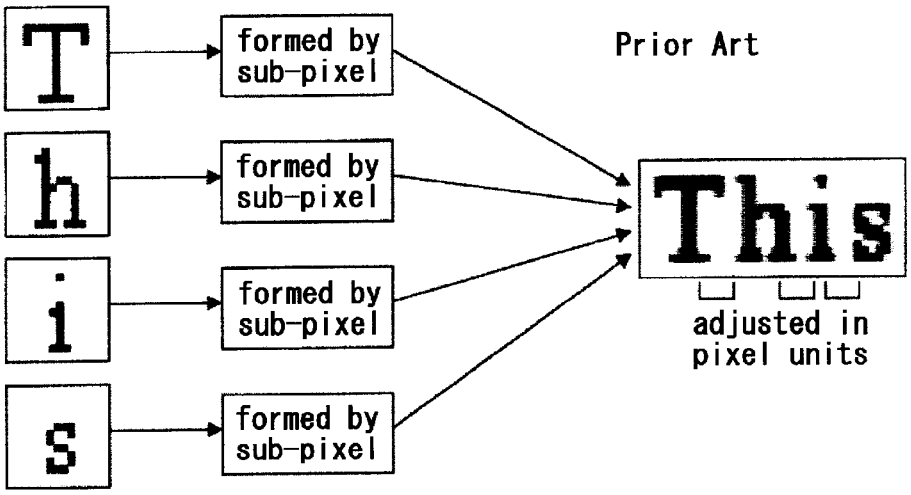
FIG. 16 is a schematic diagram of a sub-pixel display by the prior art.

Here, a comparison of FIG. 16, of the prior art, and FIG. 15, of the present invention, shows that this invention is beneficial for accuracy kerning and other inter-character settings (kerning is varying the spacing between two letters depending on the particular letters involved in order to attain a more apparent uniformity of letter spacing). That is, the spacing of the prior art in FIG. 16 is at least the three sub-pixel spaces of a pixel, whereas, the spacing of the present invention in FIG. 15 can be as fine as a single sub-pixel.

Figure 17:
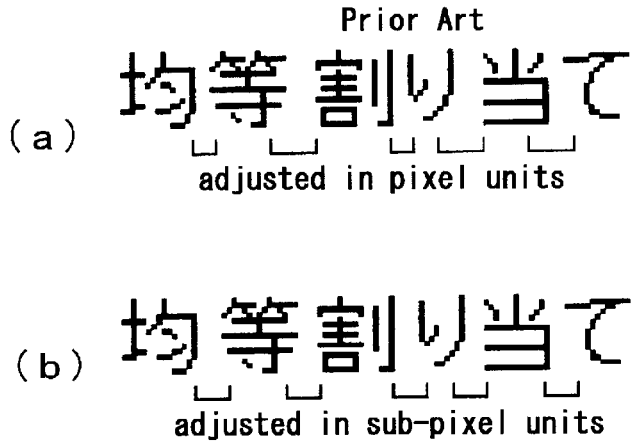
FIG. 17(*a*) is an example diagram of a display by the prior art.

Furthermore, the display level of the display means 23 can be set to the sub-pixel level for various character formats, such as both-end equal spacing, right justify, left justify, and centering. That is, an example of a display using sub-pixel spacing of this invention is shown in FIG. 17(*b*) for characters of Japanese text, for comparison with the same text displayed in the prior art of FIG. 17(*a*). The comparison shows that the character intervals are more appropriate and the display is more pleasing with the present invention.

The third embodiment provides the following effects.

(Effect 1) Fine display is available at sub-pixel precision, which is three times finer than a single pixel. This permits a display to be created that is much closer in appearance to printed text or characters. Improving the precision of character intervals creates a display having the appearance of fixed pitch and higher uniformity.

(Effect 2) The energy collection of the light-emitting elements is made appropriate to create a display that is easy to view.

(Effect 3) Sub-pixel display of a character string can be performed in various units.

(Effect 4) Sub-pixel display of a character string can be performed in various formats.

(Fourth Embodiment)

Figure 18:
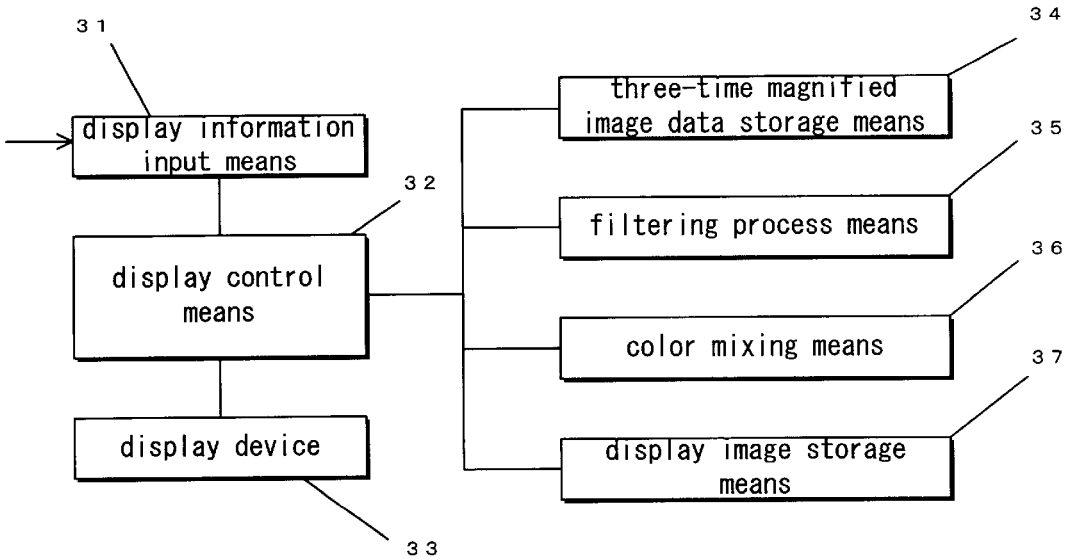
FIG. 18 is a block diagram of a display equipment according to a fourth embodiment of this invention.

The fourth embodiment is intended to achieve the third object of the invention. Referring to FIG. 18 a display information input means 31 inputs display information. A display control means 32 controls the various elements of FIG. 18 to enable a display device 33 to perform display based on the display image, which is stored in an display image storage means 37 for sub-pixel display. The display image storage means 37 may be of any convenient type such as, for example a VRAM.

With the display device 33, three light-emitting elements, which respectively emit light of the three primary colors of R, G, and B, are aligned in a fixed order to form one pixel. A plurality of pixels are aligned in a first direction to form one line. A plurality of lines are aligned in a second direction, which is orthogonal to the first direction, to form the display screen. To be more specific, the display device 33 may be, for example, a color LCD or a color plasma display, together with a driver which drives the respective elements of the color LCD or color plasma display.

Figure 21:
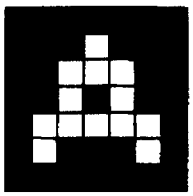
FIG. 21 is an example diagram of an image of the fourth embodiment of this invention.
Figure 22:
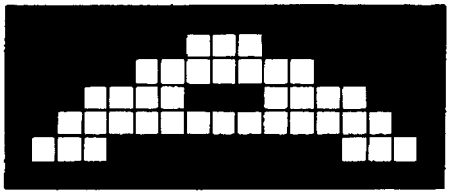
FIG. 22 is an example diagram of a three-times magnified image of the fourth embodiment of this invention.

A three-times magnified image data storage means 34 stores the three-times magnified image (the sub-pixel image corresponding to the three light-emitting elements of R, G, and B) corresponding to the display information to be input from the display information input means 31. Here, three-times magnified image data, such as shown in FIG. 22, is generated from an ordinary image data that is not magnified by three as shown in FIG. 21 and stored in the three-times magnified image data storage means 34. Alternatively, the three-times magnified image data, such as shown in FIG. 22, may be stored from the beginning in the three-times magnified image data storage means 34.

The filtering process means 35 performs a filtering process on the three-times magnified image stored in the three-times magnified image data storage means 34 and outputs the obtained values to a color mixing means 36. The filter factors of the filtering process means 35 may be such as to perform equal (⅓) energy collection from among the respective light-emitting elements as disclosed in the literature introduced in the "Related Art" section. The factors may also be determined in one stage or in two stages.

The process of the color mixing means 36 is now be described with reference to FIGS. 21 to 23. It should be understood that although the image shown in FIG. 23 is actually a multi-value color image, since patents can only be illustrated in black and white due to drawing restrictions, the image is displayed in a simulated gradation by which the multi-value color image is patterned.

Figure 23:
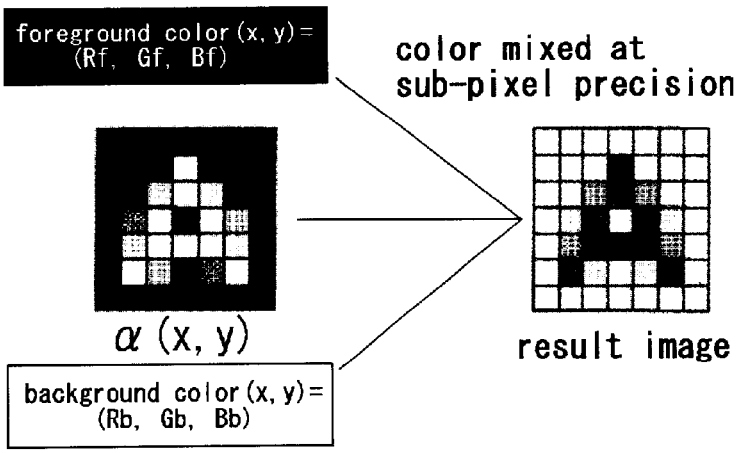
FIG. 23 is an explanatory diagram of the process of color mixing by the fourth embodiment of this invention.
Figure 24:
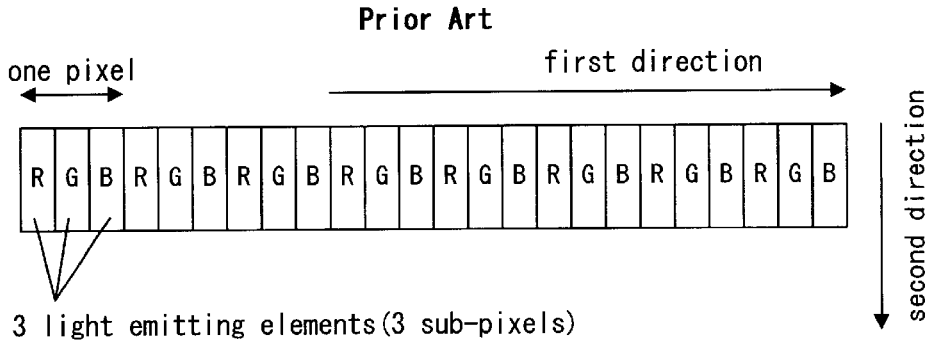
FIG. 24 is a schematic diagram of one line of the prior art.
Figure 25:
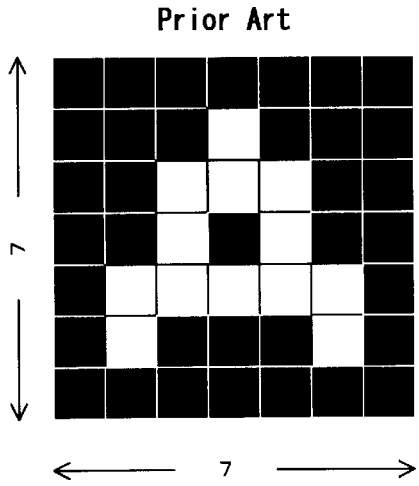
FIG. 25 is an example diagram of an original image of the prior art.
Figure 26:
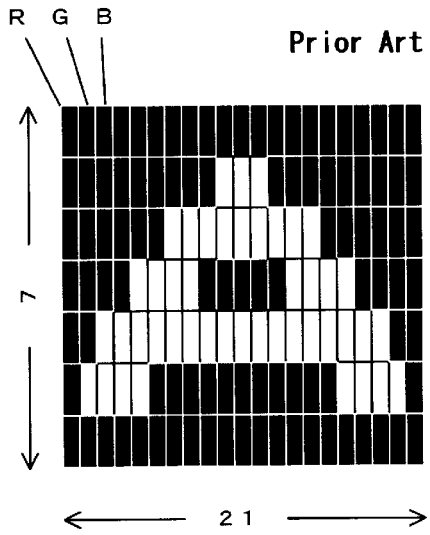
FIG. 26 is an example diagram of a three-times magnified image of the prior art.
Figure 27:
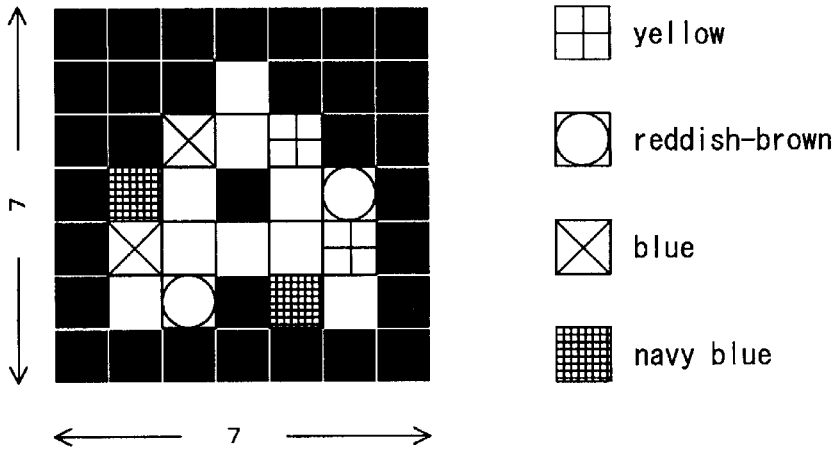
Fig. 27 Prior Art
FIG. 27 is an explanatory diagram of the color determination process of the prior art.
Figure 28A:
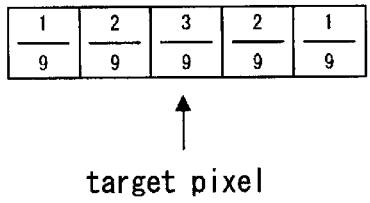
Prior Art Fig. 28(a)
FIG. 28(*a*) is an explanatory diagram of the filtering process factors of the prior art.
Figure 28B:
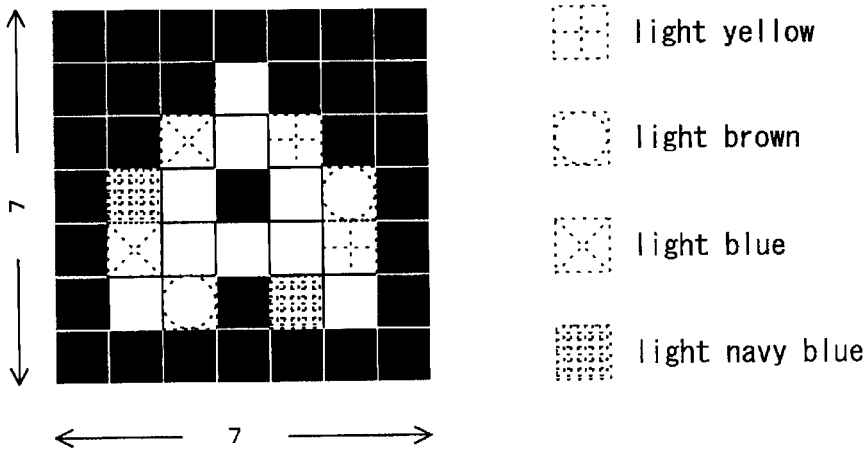
Prior Art Fig. 28(b)
Figure 29A:
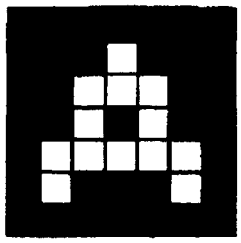
Prior Art Fig. 29(a)
FIG. 29(*a*) is an example diagram of an image of the prior art.
Figure 29B:
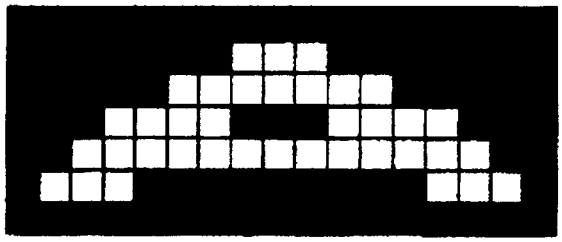
Figure 29C:
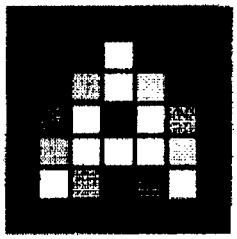

First, before the color mixing means 36 performs its process, the filtering process means 35 generates, based on the three-times magnified image data of FIG. 22, an image that appears uncolored as a whole as shown in the middle stage of the left side of FIG. 23. This step is similar to the prior art.

However, the color mixing means 36 performs the following process to enable performing a color-compatible sub-pixel display. For the sake of description, the first direction is defined as the x direction (the horizontal direction in FIG. 23) and the second direction is defined as the y direction. However, the definitions of x and y can be reversed without departing from the spirit and scope of the invention.

Figure 20:
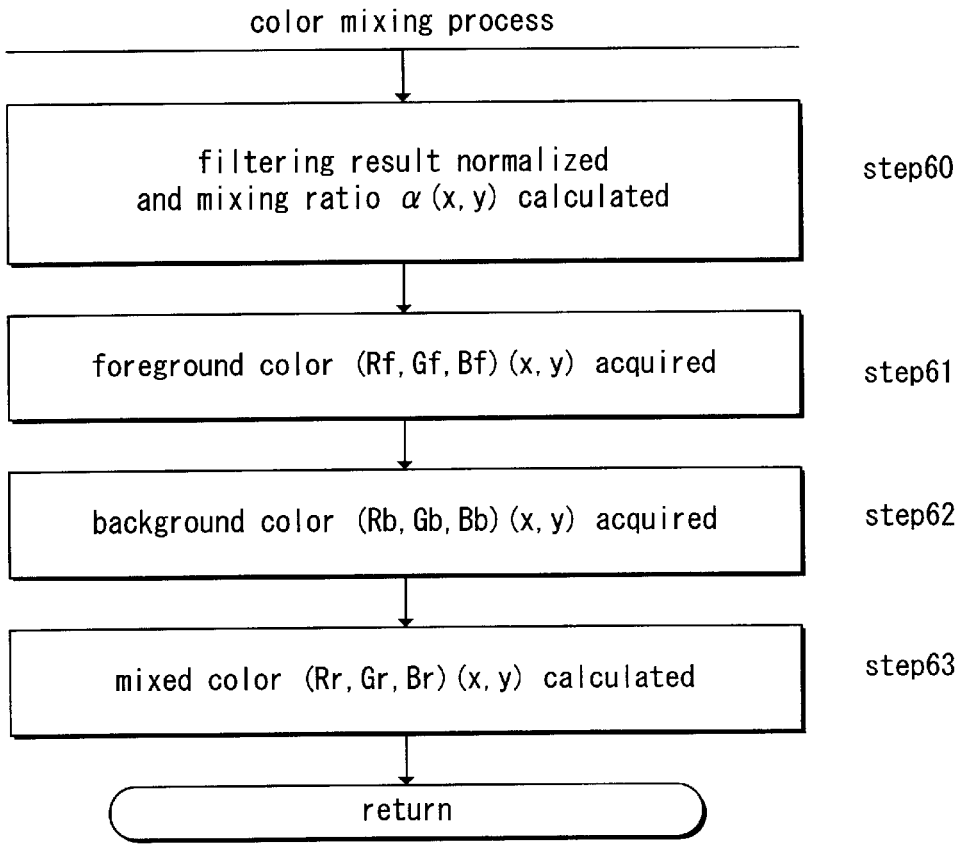
FIG. 20 is a flowchart of the color mixing process of the fourth embodiment of this invention.

Referring now to FIG. 20, in step 60, the color mixing means 36 inputs the values, Val(x, y), of the respective pixels from the filtering process means 35. The color mixing means 36 then normalizes these values, Val(x, y), so that they take on normalized values from 0.0 to 1.0. One skilled in the art will recognize that the number of significant digits is not limited to 2 but that the number may be changed to other values.

In the present example, the value, Val(x, y), is of 8-bit precision and the range of the value of Val(x, y), is thus 0, 1, 2, . . . , 255.

The color mixing means 36 obtains the normalized mixing ratios, α(x, y), for the respective pixels, (x, y) by the calculation:

$$\text{mixing ratio } \alpha(x, y)=Val(x, y)/255.$$

Next in steps 61 and 62 of FIG. 20, the color mixing means 36 acquires the foreground colors, (Rf, Gf, Bf)(x, y), and background colors, (Rb, Gb, Bb)(x, y) (hereinafter, the colors are indicated with the (x, y) being omitted).

The order of the processes of steps 60 to 62 may be interchanged at will.

Upon acquiring the above information, the color mixing means 36 performs color mixing at sub-pixel precision using formula 1 in step 63:

Formula 1

$$Rr(x, y)=\alpha(sx, y)\times Rf(x, y)+\{1.0-\alpha(sx, y)\}\times Rb(x, y)$$

$$Gr(x, y)=\alpha(sx+1, y)\times Gf(x, y)+\{1.0-\alpha(sx+1, y)\}\times Gb(x, y)$$

$$Br(x, y)=\alpha(sx+2, y)\times Bf(x, y)+\{1.0-\alpha(sx+2, y)\}\times Bb(x, y)$$

x=3×sx x: in pixel units sx: in sub-pixel units

α: normalized from 0.0 to 1.0

It should be noted that in the above formula, the sub-pixel unit x coordinate of sx is used as the x coordinate of the mixing ratio α.

More preferably, the color mixing means 36 uses formula 2.

Formula 2

$$Rr(x, y)=[\alpha(sx, y)\times Rf(x, y)+\{255-\alpha(sx, y)\}\times Rb(x, y)]/255$$

$$Gr(x, y)=[\alpha(sx+1, y)\times Gf(x, y)+\{255-\alpha(sx+1, y)\}\times Gb(x, y)]/255$$

$$Br(x, y)=[\alpha(sx+2, y)\times Bf(x, y)+\{255-\alpha(sx+2, y)\}\times Bb(x, y)]/255$$

x=3×sx x: in pixel units sx: in sub-pixel units

α: 0~255 (8 bit)

Expression of the foreground color values, background values, and mixing ratios at 8-bit precision is favorable in that computation is facilitated. Needless to say, the above formulae are examples and may be replaced by other equivalent formulae without departing from the spirit and scope of the invention.

By the above processes, the mixed colors (Rr, Gr, Br) of pixels (x, y) are determined as shown at the right side of FIG. 23. Here, the background color (Rb, Gb, Bb) may take on a different RGB value pixel by pixel (x, y) and the foreground color (Rf, Gf, Bf) may also take on a different RGB value pixel by pixel (x, y).

Thus, for example, a full-color background image can be displayed in the background, and a logo display can be made in red color in front of a background image. Moreover, the characters (logo) at the front are displayed in sub-pixel units and are thus displayed clearly and in an easily viewed manner.

In FIG. 18, the display image storage means 37 may be, for example, a VRAM, which stores the color image at sub-pixel precision after color mixing by the color mixing means 36.

Figure 19:
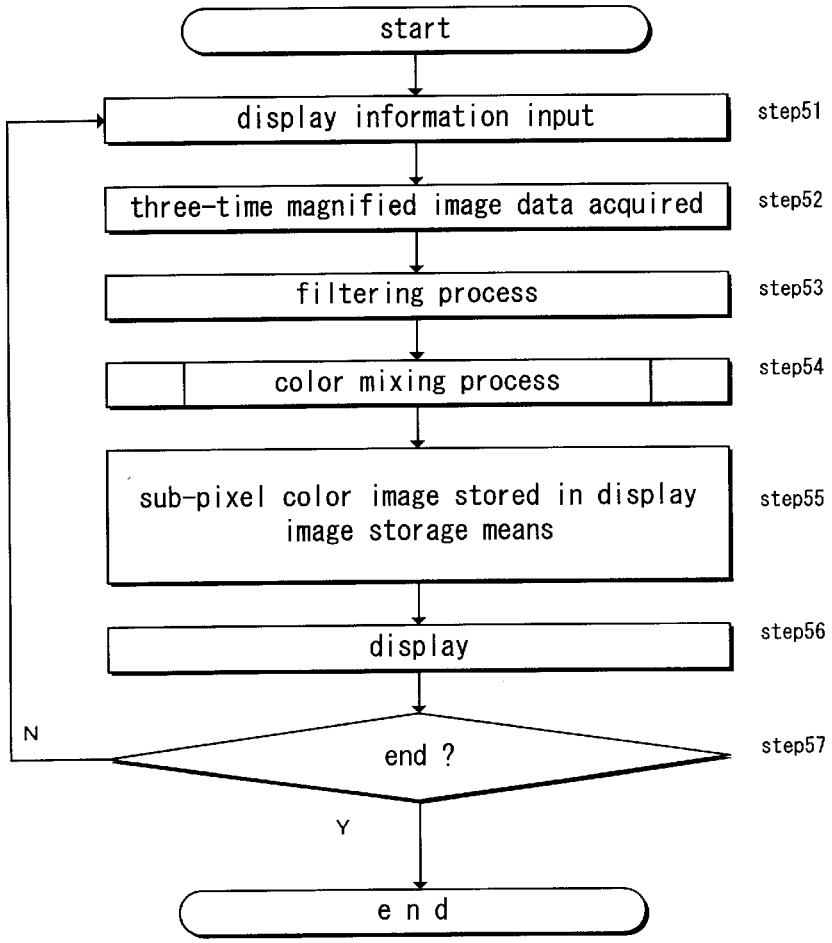
FIG. 19 is a flowchart of the display equipment of the fourth embodiment of this invention.

Based on the above description, the flow of the display method of the present embodiment is now described with reference to FIG. 19. First, in step 51, the display information is input to the display information input means 31.

The three-times magnified image (sub-pixel image) corresponding to the input display information is then taken from the three-times magnified image data storage means 34 (step 52). Although this image is typically raster font data, it may obviously be an arbitrary image besides a font.

Next in step 53, the display control means 32 transfers the acquired three-times magnified image to the filtering process means 35. The filtering process means 35 performs the filtering process.

After completion of the filtering process, the filtering process means 35 transfers the processed image data to the color mixing means 36. Then in step 54, the color mixing means 36 performs the color mixing process as has been described above. Thereafter, the sub-pixel color image, after color mixing, is stored in the display image storage means 37 (step 55).

Then in step 56, the display control means 32 enables the display device 33 to display the image based on the color image stored in the display image storage means 37. Until the display is completed (step 57), the display control means 32 returns the process to step 51.

The fourth embodiment provides the following effects.

Since the sub-pixel rendering is color-compatible, the range over which sub-pixel rendering is enabled is expanded greatly. Put another way, since sub-pixel display is performed on a color image, the clarity of the color display is improved.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A display equipment, comprising:

a display device;

said display device including first, second and third light-emitting elements, which respectively emit light of the three primary colors of R, G, and B;

said first, second and third light-emitting elements are aligned in a fixed order in a first direction to form one pixel;

a plurality of said pixels are aligned in a said direction to form one line;

a plurality of said lines are aligned in a second direction, which is orthogonal to said first direction, to form a display screen;

a display image storage means for storing display image information to be displayed on said display device;

a display control means;

said display control means including means for controlling said display device to perform display based on said display image information stored by said display image storage means;

an original image data storage means;

said original image data storage means including means for storing a raster image to be displayed currently;

a three-times magnified pattern determination means;

said three-times magnified pattern determination means for determining, based on the raster image in said original image data storage means, a three-times magnified pattern in which said display image information is magnified by three in said first direction;

said three-times magnified pattern determination means includes means for referencing a reference pattern storage means, which stores three-times magnified pattern determination rules using bit strings for indices and using storage structures for association;

said display image storage means including means for storing said three-times magnified pattern produced by said three-times magnified pattern determination means;

said three-times magnified pattern determination means determines a three-times magnified pattern, in which a target pixel in said raster image stored in the original image data storage means is magnified by three in said first direction, in accordance with a rectangular reference pattern of a total of $(2n+1)\times(2m+1)$ (where n and m are natural numbers) pixels consisting of said target pixel and pixels that surround said target pixel; and said display control means enables said display device to perform display upon allocating said three-times magnified pattern to said first, second and third light-emitting elements that form one pixel.

2. A display equipment as set forth in claim 1, wherein n=1 and m=1.

3. A display equipment as set forth in claim 1, wherein said raster image stored by said original image data storage means is one of a bit map font, a bit map image, formed by raster development of a vector font, and a raster image that is not a font.

4. A display equipment as set forth in claim 2, wherein said raster image stored by said original image data storage means is one of a bit map font, a bit map image, formed by raster development of a vector font, and a raster image that is not a font.

5. A display equipment as set forth in claim 1, wherein said three-times magnified pattern determination means includes means for referencing a reference pattern storage means, which stores three-times magnified pattern determination rules, to determine said three-times magnified pattern.

6. A display equipment as set forth in claim 5, wherein information for pattern matching of said reference pattern, is stored in said reference pattern storage means.

7. A display equipment as set forth in claim 5, wherein a bit string, which expresses said reference pattern in the form of bits, and information indicating a three-times magnified pattern for this bit string, are stored in an associated manner in said reference pattern storage means.

8. A display equipment as set forth in claim 1, wherein said three-times magnified pattern determination means determines said three-times magnified pattern by referencing calculation results of a three-times magnified pattern logical operation means, which performs logical operations based on said reference pattern.

9. A method of performing display with a display device comprising:

forming a display screen by forming first, second and third light-emitting elements, which respectively emit light of the three primary colors of R, G, and B;

aligning said first, second and third light-emitting elements in a fixed order in a first direction to form one pixel;

aligning a plurality of said pixels in said first direction to form one line;

aligning a plurality of said lines in a second direction, which is orthogonal to said first direction, to form said display screen;

forming a three-times magnified pattern, with which a target pixel in a raster image to be displayed currently is magnified by three in said first direction;

storing three-times magnified pattern determination rules using bit strings for indices and using storage structures for association in a reference pattern storage means;

said forming step including obtaining said determination rules from said reference pattern storage means for determining the three-times magnified pattern;

said raster image being determined in accordance with a rectangular reference pattern of a total of $(2n+1)\times(2m+1)$ (where n and m are natural numbers) pixels consisting of a target pixel and pixels that surround said target pixel; and allocating said three-times magnified pattern to said first, second and third light-emitting elements making up one pixel, thereby driving said display device.

10. A display method as set forth in claim 9, wherein n=1 and m=1.

11. A display method as set forth in claim 9, wherein said raster image is one of a bit map font, a bit map image, formed by raster development of a vector font, and a raster image that is not a font.

12. A display method as set forth in claim 9, wherein in the process of determining the three-times magnified pattern, determining said three-times magnified pattern by referencing three-times magnified pattern determination rules stored in a reference pattern storage means.

13. A display method as set forth in claim 12, further comprising storing information for pattern matching of said reference pattern in said reference pattern storage means.

14. A display method as set forth in claim 12, further comprising storing in said reference pattern storage means a bit string, which expresses said reference pattern in the form of bits, and information indicating a three-times magnified pattern for said bit string, in an associated manner.

15. A display method as set forth in claim 9, further comprising determining said the three-times magnified pattern by referencing a calculation results of a three-times magnified pattern logical operation means, which performs logical operations based on said reference pattern.

16. A storage medium storing a display control program, comprising:

said display control program being of a type for performing display with a display device;

said display device including first, second and third three light-emitting elements, which respectively emit light of three primary colors of R, G, and B;

said first, second and third light-emitting elements are aligned in a fixed order to form one pixel;

a plurality of said pixels are aligned in a first direction to form one line;

a plurality of said lines are aligned in a second direction, which is orthogonal to said first direction, to form a display screen;

means for determining a three-times magnified pattern, in which a target pixel in a raster image to be displayed currently is magnified by three in said first direction, in accordance with a rectangular reference pattern of a total of $(2n+1)\times(2m+1)$ (where n and m are natural numbers) pixels consisting of a target pixel and pixels that surround said target pixel;

said three-times magnified pattern determination means includes means for referencing a reference pattern storage means, which stores three-times magnified pattern determination rules using bit strings for indices and using storage structures for association: and means for enabling said display device to display by allocating said three-times magnified pattern to said first, second and third three light-emitting elements that form one pixel.

* * * * *

UNITED STATES PATENT AND TRADEMARK OFFICE

CERTIFICATE OF CORRECTION

PATENT NO. : 6,756,992 B2
DATED : June 29, 2004
INVENTOR(S) : Tadanori Tezuka et al.

It is certified that error appears in the above-identified patent and that said Letters Patent is hereby corrected as shown below:

Title page,
Item [56], References Cited, FOREIGN PATENT DOCUMENTS,
delete second occurrence of "WO 01/09824 7/2000"; and
delete second occurrence of "WO 00/21068 4/2000".
Item [57], ABSTRACT,
Line 4, after "aligned in" delete "a".
Line 16, after "precison" delete "precision".

Column 20,
Line 43, after "association" delete ":" and insert -- ; --.

Signed and Sealed this

Thirty-first Day of January, 2006

JON W. DUDAS
*Director of the United States Patent and Trademark Office*